US006062003A

United States Patent [19]

Freeman et al.

[11] Patent Number: 6,062,003

[45] Date of Patent: May 16, 2000

[54] SEALING AND DESKEWING DEVICE FOR A MAILING MACHINE

[75] Inventors: Gerald C. Freeman, Norwalk; Thomas M. Helit, Bethel, both of Conn.

[73] Assignee: Pitney Bowes Inc., Stamford, Conn.

[21] Appl. No.: 09/193,983

[22] Filed: Nov. 18, 1998

[51] Int. Cl.[7] ..... B65B 43/26

[52] U.S. Cl. ..... 53/569; 53/284.3; 53/377.4; 53/377.6

[58] Field of Search ..... 53/569, 377.4, 53/377.6, 460, 284.3, 476, 206, 387.2; 156/441.5, 442, 442.1, 442.2; 493/260, 261

[56] References Cited

U.S. PATENT DOCUMENTS

| | | | |
|---|---|---|---|
| 4,773,962 | 9/1988 | Garrigue et al. | 156/442.1 |
| 5,098,734 | 3/1992 | O'Dea et al. | 427/8 |
| 5,180,151 | 1/1993 | Branecky et al. | 493/420 |
| 5,518,674 | 5/1996 | Yates et al. | 156/442.1 |
| 5,665,198 | 9/1997 | Bieber et al. | 156/442.1 |
| 5,740,728 | 4/1998 | DeBarber et al. | 101/93 |
| 5,809,752 | 9/1998 | Holbrook | 53/569 |
| 5,813,327 | 9/1998 | Freeman et al. | 101/93 |

*Primary Examiner*—Eugene L. Kim

*Attorney, Agent, or Firm*—Steven J. Shapiro; Michael E. Melton

[57] ABSTRACT

In a mailing machine which transports along a feed path a mailpiece having a moistened flap and a main body portion, a sealing and deskewing device comprising structure for transporting the mailpiece through the mailing machine; a first roller mounted for rotation and having a first roller surface; and a second roller mounted for rotation and having a conical segment and at least one other segment, wherein at times when the mailpiece is transported between the first and second rollers in a skewed orientation relative to the feed path the conical segment operatively cooperates with the transporting means to deskew the mailpiece relative to the feed path and concurrently the first roller surface operatively cooperates with the at least one other segment to apply pressure to the moistened flap to seal the moistened flap to the main body portion.

6 Claims, 4 Drawing Sheets

SEALING AND DESKEWING DEVICE FOR A MAILING MACHINE

BACKGROUND

This invention relates to a sealing device in a mailing machine and more particularly relates to a sealing device which also deskews misaligned mailpieces being processed through the mailing machine.

Mailing machines which process pieces of mail (such as envelopes) through a plurality of processing stations are well known and embodied, for example, in U.S. Pat. No. 5,098,734 which issued to O'Dea, et al. on Mar. 24, 1992. These mailing machines typically singulate and transport individual envelopes through an envelope flap moistener, a flap sealing device, and a postage meter where printing of postage on the envelope occurs. Most postage meters utilize a rotary drum with a die thereon or a flatbed type of die for printing the postage on the envelope. The inks used in these postage meters are oil-based inks which are very stable in water. Therefore, if the surface of the envelope being printed on becomes wet due to excess moistening fluid which has been deposited thereon by the sealing device, the printed postage will still be satisfactorily printed onto the envelope.

Currently, because of environmental concerns, the use of water based inks in postage meters is highly desirable. Moreover, because of the flexibility in printing provided by digital printing devices, there is a trend to incorporate digital printers utilizing ink jet printing technology in postage meters for the purpose of printing the postal indicia and an optional advertising slogan on the envelope. One of the more common ink jet printers incorporates bubble jet printing technology which requires the utilization of a water-based ink in order to operate. However, since the very nature of a water-based ink is that it is soluble in water, a problem exists in that if any water is present on the print surface of the envelope. That is, the image which is printed by a bubble jet printer on the moistened envelope will be smeared and of a degraded quality because the water based ink will react and begin to dissolve in the water which is present on the envelope print surface.

Another important aspect of ink jet printers is that the surface of the item which is printed on must be registered a fixed distance from the nozzles of the ink jet printer in order to achieve good quality printing. In U.S. Pat. Nos. 5,740,728 and 5,813,327, which are hereby incorporated by reference, an endless belt is used to transport and register the mailpieces against the bottom side of a transport deck. The printer is positioned a fixed distance from the deck and prints onto the mailpiece through an opening in the deck. Accordingly, since the endless belt registers the mailpiece against the underside of the deck and the printer is positioned a fixed distance from the deck, the desired gap between the printer and the printing surface of the mailpiece is accurately maintained.

However, the above described endless belt transport device requires that the endless belt be positioned away from a rear mailpiece registration wall. This allows the mailpiece to pass under the printer and to provide room for a mailpiece flap folding skin which folds the mailpiece flap against the mailpiece body prior to its passing between a roller flap sealing assembly. The endless transport belt acts on the outboard side of the mailpiece and passes around backup rollers which cooperate with spring biased idler rollers to jointly transport the mailpiece. However, due to the space constraints required for the flap ski, when small mailpieces (i.e. 5⅛ inches long) are being transported they will only be in a single backup roller/idler roller nip for a short distance prior to entering into the sealing roller nip. During this period of time, the registration wall and the flap folding ski create drag on the inboard side of the mailpiece while the outboard side is being driven by the endless belt assembly. The drag causes a torque to be created on the mailpiece that moves the trailing edge away from the registration wall while placing the mailpiece in a skewed orientation relative to the registration wall. The mailpiece then continues to be transported in a skewed orientation through the mailing machine to the printer so that a postage indicia is printed in a skewed orientation relative to the top of the mailpiece.

Thus, what is needed is a sealing device which seals the envelope flap of a mailpiece being transported in a skewed alignment and concurrently deskews the misaligned mailpiece.

SUMMARY OF THE INVENTION

The above object is met by providing in a mailing machine which transports along a feed path a mailpiece having a moistened flap and a main body portion, a sealing and deskewing device including structure for transporting the mailpiece through the mailing machine; a first roller mounted for rotation and having a first roller surface; and a second roller mounted for rotation and having a conical segment and at least one other segment, wherein at times when the mailpiece is transported between the first and second rollers in a skewed orientation relative to the feed path the conical segment operatively cooperates with the transporting means to deskew the mailpiece relative to the feed path and concurrently the first roller surface operatively cooperates with the at least one other segment to apply pressure to the moistened flap to seal the moistened flap to the main body portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
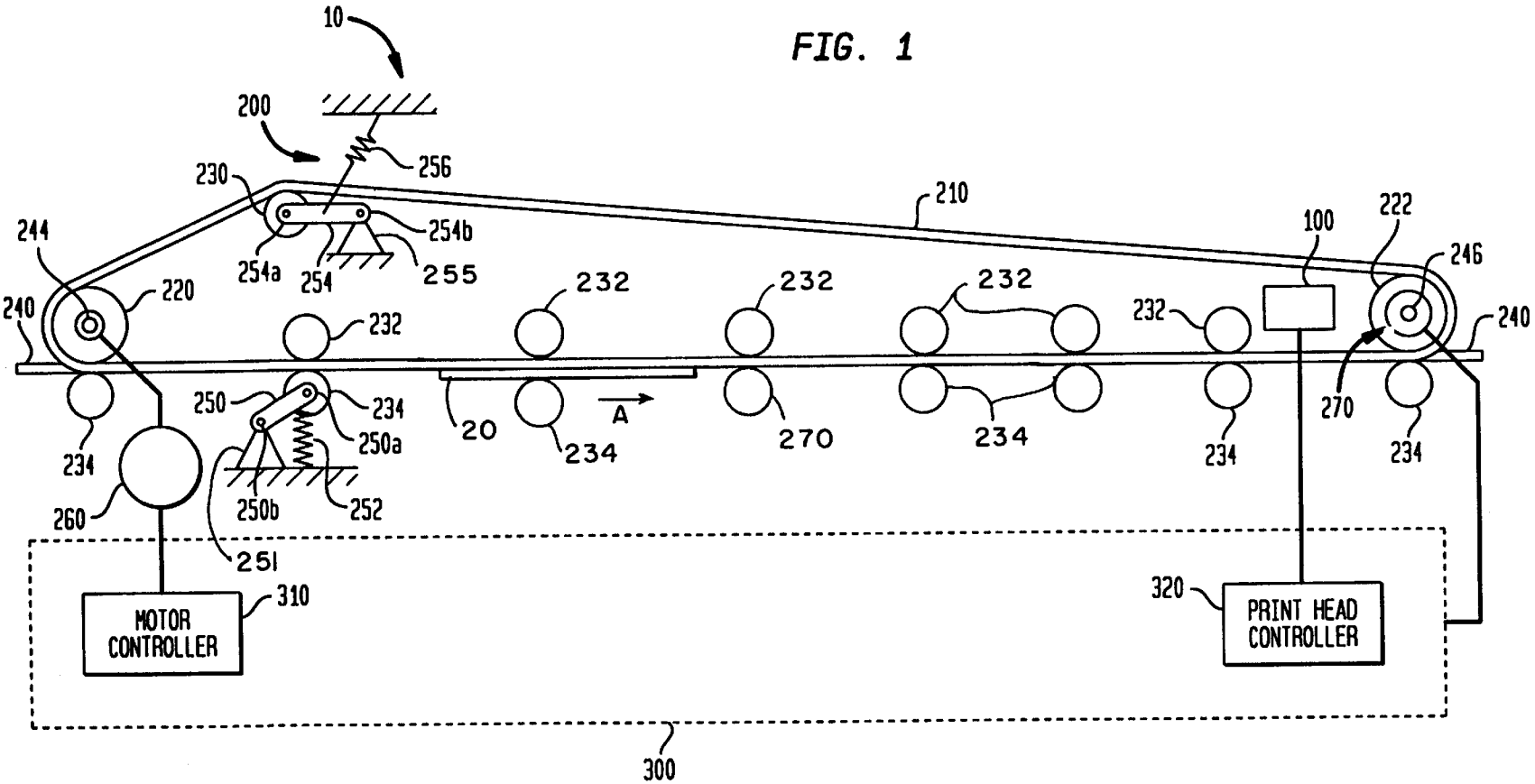
FIG. 1 is a schematic side view of a partial mailing machine including a sealing and deskewing device in accordance with the instant invention.

Referring to FIG. 1, a mailing machine 10 includes a print head module 100, a transport apparatus 200 and a micro control system 300 (including a motor controller 310 and a print head controller 320). The transport apparatus 200 feeds envelopes in a seriatim fashion in a path of travel along a deck 240, as indicated by arrow "A", past the print head module 100 so that an indicia of postage can be printed on each envelope 20. The print head module 100 is of an ink jet print head type having a plurality of ink jet nozzles (not shown) for ejecting droplets of ink in response to appropriate signals. The print head module 100 may be of any conventional type such as those commonly available from Hewlett-Packard Company, Canon Inc., and Brother Industries of Japan.

The transport apparatus 200 includes an endless belt 210 looped around a drive pulley 220 and an encoder pulley 222 which is located downstream in the path of travel from the drive pulley 220 and proximate to the print head module 100. The drive pulley 220 and the encoder pulley 222 are substantially identical and are fixedly mounted to shafts 244 and 246, respectively, which (although not shown) are in turn respectively rotatively mounted to registration wall 247 and frame 233 (see FIG. 2). The shaft 244 is operatively connected to a motor 260 by any conventional means such as intermeshing gears (not shown) or a timing belt (not shown) so that when the motor 260 rotates is response to signals from the motor controller 310, the drive pulley 220 also rotates which in turn causes the endless belt 210 to rotate and advance the envelope 20 along the path of travel.

The transport apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The tensioner pulley 230 is rotatively mounted to one end 254*a* of an arm 254 while the other end 254*b* of the arm 254 is pivotally mounted to any suitable fixed structure 255. An extension spring 256 is fixed at one end while the other end is mounted along the span of the arm 254 so as to bias the tensioner pulley 230 outward against the endless belt 210. The idler pulleys 232 are rotatively mounted between opposing walls of frame 33 along the path of travel between the drive pulley 220 and the encoder pulley 222. The shaft 244 has frame 233 mounted thereon so that the entire frame 233 can be lifted and pivoted about shaft 244 for jam clearance purposes.

The normal force rollers 234 are located in opposed relationship to and biased toward the idler pulleys 232, the drive pulley 220 and the encoder pulley 222, respectively. In a first embodiment, each normal force roller 234 is rotatively mounted to one end 250*a* of an arm 250 while the other end of the arm 254 is pivotally mounted to a fixed structure 251. For the sake of simplicity, a suitable mounting arrangement is only shown with respect to one of the normal force rollers 234. A compression spring 252 is fixed at one end while the other end is fixed to arm 250 so as to bias the normal force roller 234 upward and into contact with the endless belt 210. In a second embodiment, which is reflected in FIG. 2, a torsion spring 255 is used in lieu of a compression spring to bias roller 234 into endless belt 210. That is, arm 250 is fixedly mounted to a shaft 256 which itself is rotatively mounted in frame 233. Roller 234 is mounted to rotate freely about a shaft 257 which is fixedly mounted in arm 250.

As described above, the normal force rollers 234 work to bias the envelope 20 is up against the deck 240. This is commonly referred to as top surface registration which is beneficial for ink jet printing. Any variation in thickness of the envelope 20 is taken up by the deflection of the normal force rollers 234. Thus, a constant gap (the distance between the print head module 100 and the deck 240) is set between the envelope 20 and the print head module 100 no matter what the thickness of the envelope 20. The constant gap is optimally set to a desired value to achieve quality printing. It is important to note that the deck 240 contains suitable openings for the endless belt 210 and normal force rollers 234.

Figure 2:
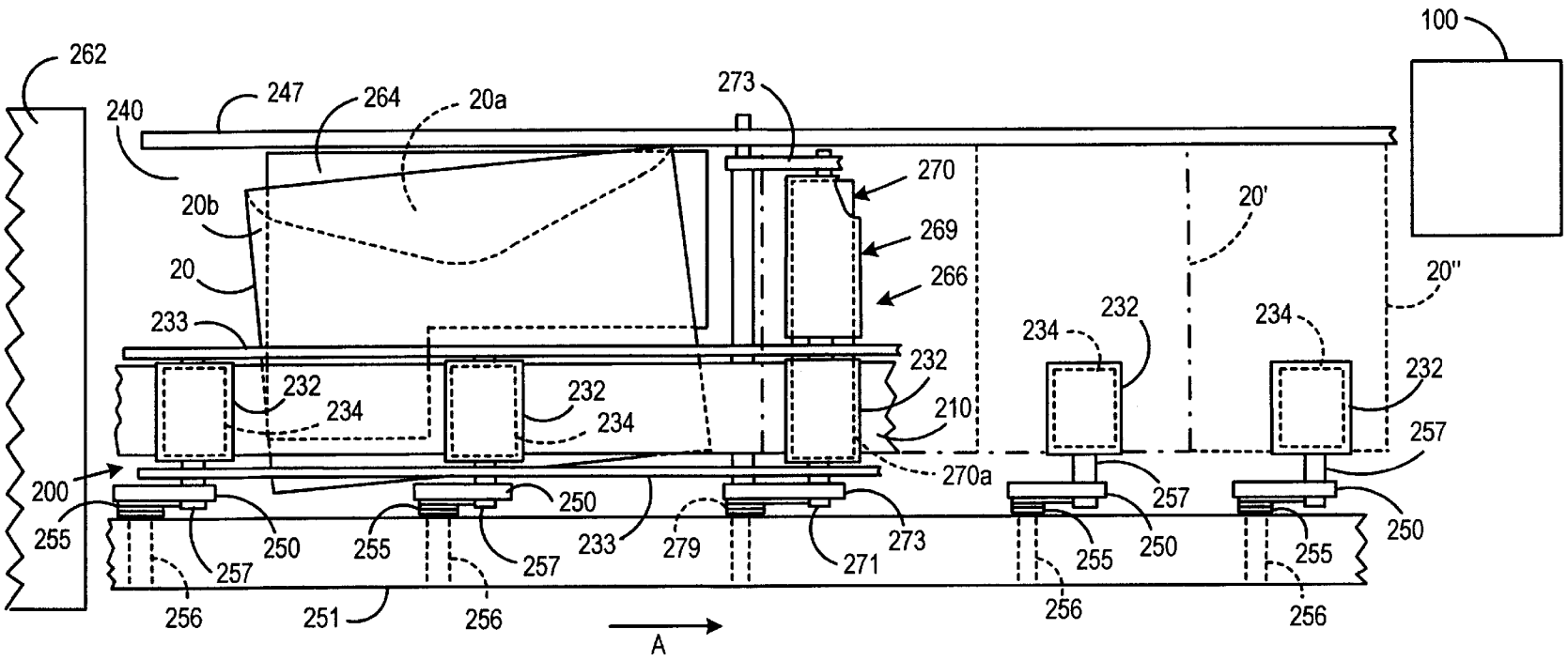
FIG. 2 is an enlarged and more detailed schematic top plan view of a portion of the mailing machine of FIG. 1.
Figure 3:
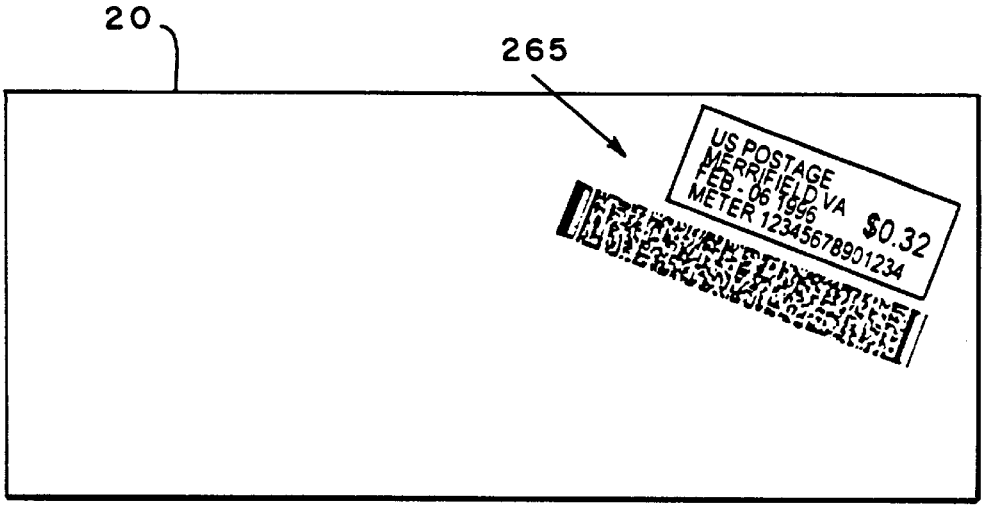
FIG. 3 shows a mailpiece with a skewed postage indicia.

Referring specifically to FIG. 2, a mailpiece 20 is shown as having just left a conventional flap moistening station 262. Mailpiece 20 is moved by transport assembly 200 over a known flap folding ski 264 which (although not shown) is biased toward mailpiece 20 in a conventional manner. As mailpiece 20 passes over flap folding ski 264, the moistened flap 20*a* is folded against the body 20*b* of mailpiece 20. However, in the position shown, mailpiece 20 is only in the grip of the second idler pulley 232/normal force roller 234 nip (as viewed from left to right in FIG. 2). Accordingly, as the transport assembly 200 moves the mailpiece 20 in the direction of arrow "A", drag is created on the inner area of the mailpiece 20 due to the flap folding ski 264 and the registration wall 247. Thus, the transport assembly 200, when moving the mailpiece 20 in the direction of arrow "A", creates a torque on mailpiece 20 in the counterclockwise direction as viewed in FIG. 2. This causes the mailpiece 20 to rotate to the position shown in FIG. 2 which is skewed relative to the registration wall 247. If the mailpiece 20 is subsequently presented to the printer 100 in this orientation, the printed indicia 265 will be skewed relative to the top edge of the mailpiece 20 as shown in FIG. 3.

Figure 4:
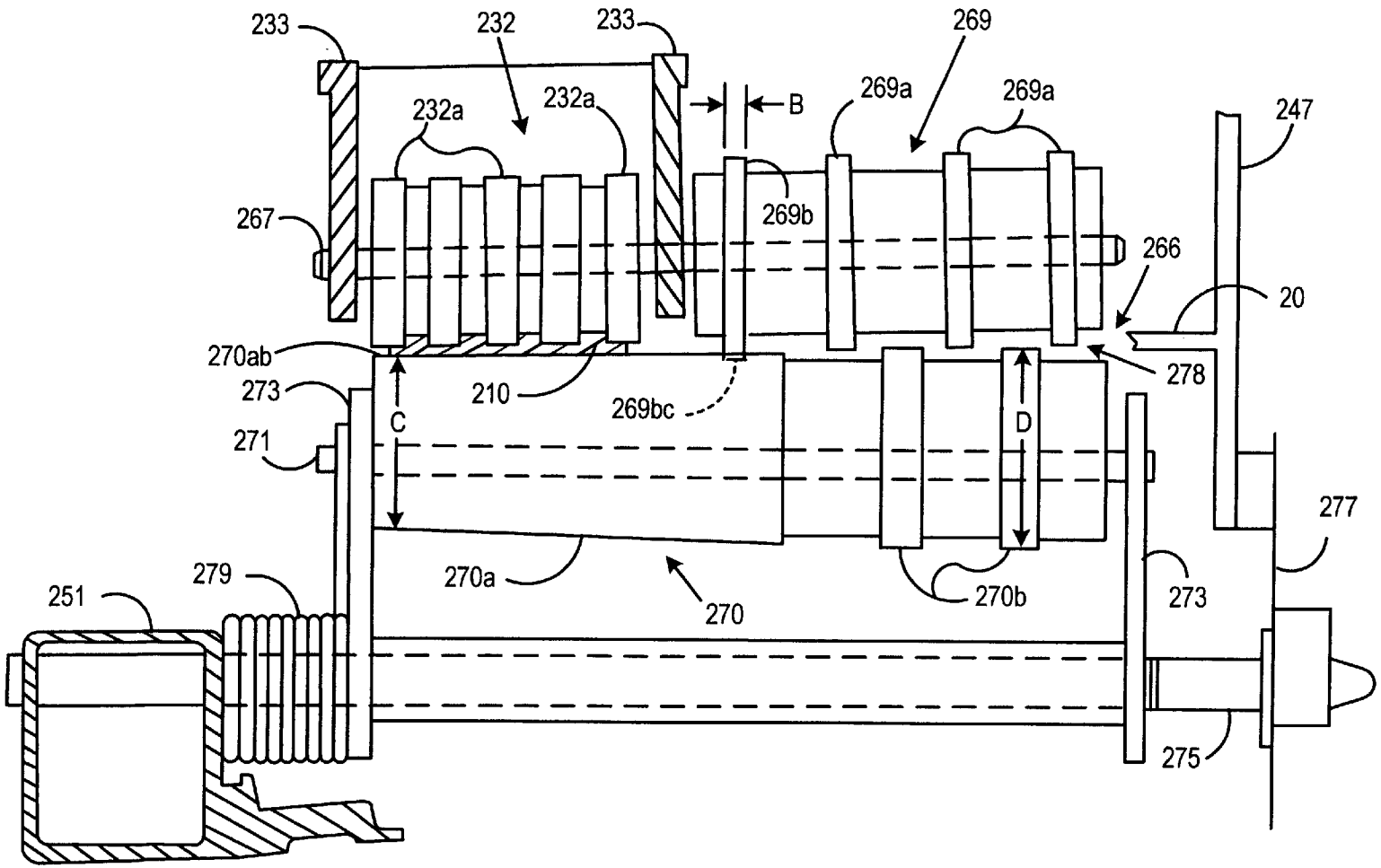
FIG. 4 is an enlarged schematic view of the mailing machine along line 3—3 of FIG. 2.

Referring to FIGS. 2 and 4, a sealing and deskewing assembly is shown at 266. The sealing and deskewing assembly 266 includes a shaft 267 fixedly mounted in frame 233. An idler pulley 232 and idler roller 269 are each mounted to be freely rotatable around shaft 267. Idler pulley 232 has segmented portions 232*a* which fit in corresponding grooves in endless belt 210. Idler roller 269 includes roller segments 269*a*, the purpose of which is discussed in more detail below. The sealing and deskewing assembly 266 further includes a sealing roller 270 which is mounted for rotation on a shaft 271 which itself is fixedly mounted in a pair of brackets 273. Brackets 273 are fixedly mounted on another shaft 275 which is mounted for rotation in frame 251 and another frame part shown schematically at 277. A torsion spring 279 is fixedly mounted at one end to shaft 271 and at the other end to shaft 275 to bias the sealing roller 270 toward idler pulley 232 and idler roller 269.

Sealing roller 270 includes a plurality of segments 270*a* and 270*b* whose outer surfaces define sealing roller 270 as being conical in shape. The position of idler roller 269 relative to sealing roller 270 is such that the outer surface 270*ab* of segment 270*a* is in a substantially parallel relationship with the bottom surface of endless belt 210. Moreover, torsion spring 279 biases the outer surface 270*ab* into contact with endless belt 210. Thus, as belt 210 is driven to transport mailpiece 20, sealing roller 270 is driven into rotation by endless belt 210.

Figure 5:
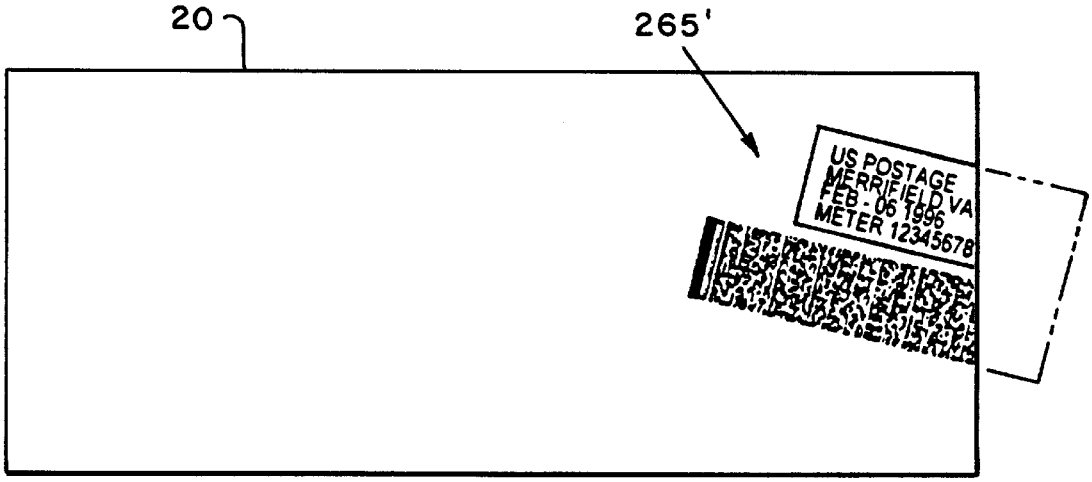
FIG. 5 shows a mailpiece with a portion of a skewed postage indicia.

Idler roller 269 includes a drive web 269*b* which is positioned to contact segment 270*a* of sealing roller 270. As sealing roller 270 is driven into rotation by endless belt 210, idler roller 269 is driven into rotation by the interaction of drive web 269*b* and segment 270*a*. This permits the mailpiece flap 20*a* to be ingested in the nip 278, defined between segments 269*a* and 270*b*, to seal flap 20*a*. The drive web 269*b* is positioned along segment 270*a* such that the velocity of the idler roller 269 is the same as the mailpiece 20 velocity thereby ensuring a smooth ingestion of the mailpiece 20 into the roller nip 278. It is important to note that the drive web 269*b* is made of a material and a specified width and thickness that allows it to compress slightly when contacting segment 270*a*. That is, in order to ensure that positive drive contact is maintained between the drive web 269*b* and segment 270*c* the relative orientation of these components is such that a lower portion 269*bc* of drive web 269*b* would normally extend below the outer surface of segment 270*c*. However, since lower portion 269*bc* contacts segment 270*c* it would cause roller 270 to pivot with shaft 275 away from lower portion 269*bc* if lower portion 269*bc* did not compress slightly. If this pivoting of sealing roller 270 occurred, the normal force applied by segment 270*a* to a mailpiece 20 passing between segment 270*a* and endless belt 210 would be reduced resulting in slipping occurring between the endless belt 210 and the mailpiece 20. If such slipping results, the delivery of the mailpiece 20 to the printer 100 will be delayed. Since the printer 100 is provided with a fire pulse based on an encoder 270 (FIG. 1) the slippage of the mailpiece 20 will not be accounted for resulting in the premature printing by the printer 100. Thus, if a skewed mailpiece 20 experiences the slippage problem discussed above, the resulting partial indicia 265' is printed as shown in FIG. 5.

Returning to sealing roller 270, it has a smallest diameter "C" at one end and gradually tapers to a largest diameter "D" at its opposite end. Since the roller 270 is driven by endless belt 210, the velocity at its surface in the diameter "C" region is smaller than the velocity in the diameter "D" region. The gradual increase in velocity across the roller 270 results in a clockwise torque being applied to the mailpiece 20 as viewed in FIG. 2. Accordingly, as the skewed mailpiece 20 passes through the sealing and deskewing assembly 266 the mailpiece 20 is rotated back into its proper position against the registration wall as shown in dashed lines at 20'. Subsequent to leaving the sealing and deskewing assembly 266, the idler pulley/normal roller 232/234 assemblies are positioned such that even the smallest envelopes are always in the grip of at least two idler pulley/normal roller assemblies 232/234. Thus, the properly registered mailpiece as shown at 20" is presented to the printer 100 for printing of the indicia 265.

With regard to sealing of the mailpiece flap 20*a*, it is sealed by the segments 269*a* and 270*b*. However, the segments 269*a* and the segments 270*b* are intentionally offset from each other. The purpose of the offset positioning is such that if excess moistening fluid from flap 20*a* is deposited on segments 270*b*, this moistening fluid cannot be transferred to the segments 269*a* because they are never in contact with the segments 270*b*. This prevents any transfer of moistening fluid from the segments 269*a* to the top surface of the mailpiece 20 in the printing area for the postage indicia 265 which would negatively impact the ability of a water-based ink printer to print a good quality postage indicia 265 The segmented sealing rollers are discussed in U.S. Pat. No. 5,809,752, which is hereby incorporated by reference.

In the event that the printer 100 does not use an aqueous based ink, the segmented rollers may not be required. In lieu thereof the sealing roller 270 could be a single non-segmented conical roller and the idler roller 269 a single non-segmented roller. This configuration would permit sealing while at the same time allowing for the deskewing of the mailpiece 20.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example, instead of a single bracket 273, independently spring loaded arms could be used to support the opposite ends of shaft 279. The spring loaded arm nearer frame 251 would be more heavily spring loaded than the arm nearer the frame 277 thereby more effectively ensuring transport of the mailpiece via the endless belt 210. The independent arms would be mounted for rotation about shaft 275.

What is claimed is:

1. In a mailing machine which transports along a feed path a mailpiece having a moistened flap and a main body portion, a sealing and deskewing device comprising:

means for transporting the mailpiece through the mailing machine;

a first roller mounted for rotation and having a first roller surface; and a second roller mounted for rotation and having a first plurality of segmented roller surfaces so that outer surfaces of the first plurality of segmented roller surfaces define the second roller as being conical, wherein at times when the mailpiece is transported between the first and second rollers in a skewed orientation relative to the feed path the conical second roller operatively cooperates with the transporting means to deskew the mailpiece relative to the feed path and concurrently the first roller surface operatively cooperates with the at least one of the first plurality of segmented roller surfaces to apply pressure to the moistened flap to seal the moistened flap to the main body portion.

2. A sealing and deskewing device as recited in claim 1, further comprising a shaft upon which the first roller is mounted for rotation and wherein the transporting means includes an endless belt driven around a plurality of idler pulleys and at least one of the plurality of idler pulleys is mounted for rotation on the shaft such that the conical second roller operatively cooperates with the at least one of the idler pulleys and the endless belt to deskew the mailpiece relative to the feed path.

3. A sealing and deskewing device as recited in claim 2, wherein the first roller surface is a second plurality of segmented roller surfaces.

4. A sealing and deskewing device as recited in claim 3, wherein the second plurality of segmented roller surfaces is opposite to and laterally and axially offset without mutual contact from the at least some of the first plurality of segmented roller surfaces.

5. A sealing and deskewing device as recited in claim 4, wherein at times when the second plurality of segmented roller surfaces and the at least some of the first plurality of segmented roller surfaces apply pressure to the moistened flap at least some moistening fluid is transferred onto the at least some of the first plurality of segmented roller surfaces from the moistened flap, and at times when the sealed mailpiece is transported away from the sealing and deskewing device the at least some of the moistening fluid is not transferred from the at least some of the first plurality of segmented roller surfaces to the second plurality of segmented roller surfaces.

6. In a mailing machine which transports along a feed path a mailpiece having a moistened flap and a main body portion, a sealing and deskewing device comprising:

means for transporting the mailpiece through the mailing machine;

a first roller mounted for rotation and having a cylindrical outer surface; and a second roller mounted for rotation and having a conical outer surface which is aligned to be substantially parallel to the cylindrical outer surface at a nip defined between the first and second rollers and wherein at times when the mailpiece is transported into the nip in a skewed orientation relative to the feed path the conical outer surface operatively cooperates with the cylindrical outer surface to concurrently deskew the mailpiece relative to the feed path and to apply pressure to the moistened flap to seal the moistened flap to the main body portion.

* * * * *